United States Patent [19]

Cheng

[11] Patent Number: 4,625,471

[45] Date of Patent: Dec. 2, 1986

[54] APPARATUS AND METHOD FOR SUPPORTING CUPBOARDS AND THE LIKE

[75] Inventor: Eric K. Cheng, London, United Kingdom

[73] Assignee: Reyloc Limited, London, England

[21] Appl. No.: 620,476

[22] Filed: Jun. 14, 1984

[30] Foreign Application Priority Data

Jun. 22, 1983 [GB] United Kingdom ..... 8316907
Oct. 10, 1983 [GB] United Kingdom ..... 8326708

[51] Int. Cl.[4] ..... A47B 5/00

[52] U.S. Cl. ..... 52/36; 108/60; 108/61; 312/257 R; 211/184

[58] Field of Search ..... 312/257, 263; 245/222.2; 403/167, 168; 108/60, 61; 211/184; 52/482, 36

[56] References Cited

U.S. PATENT DOCUMENTS 2,728,480 12/1955 Close ..... 312/263
2,845,188 7/1958 Rosenquist ..... 211/184
3,695,568 10/1972 Hogrebe ..... 248/222

FOREIGN PATENT DOCUMENTS 510146 2/1955 Canada ..... 211/184
283000 12/1952 Switzerland ..... 211/184

*Primary Examiner*—Henry E. Raduazo
*Attorney, Agent, or Firm*—Morgan & Finnegan

[57] ABSTRACT

Apparatus for building, erecting or suspending structures includes a substantially horizontal elongate linear support member and a panel wherein the panel is releasably attached to the support member utilizing a "lift and rotate" assembly procedure. Suitable parts on the panel or on a bracket fixed thereto are capable of inter-engaging with the support member.

The elongate linear support member preferably has a vertical web and a horizontal web, the vertical web being provided with a horizontally extending flange, the linear support member being constructed to cooperate with a panel intended to hang substantially vertical from the support member with its plane substantially perpendicular to the length of the support member. There is an engaging means between the upper edge of the panel and the support member and arranged to preclude horizontal separation of the panel and the support member once they are assembled together. The panel has a notch in its inner edge, the notch being positioned and dimensioned to receive the said flange to provide vertical support for the panel when the panel is presented to and hung from the support member.

10 Claims, 19 Drawing Figures

APPARATUS AND METHOD FOR SUPPORTING CUPBOARDS AND THE LIKE

FIELD OF THE INVENTION

This invention relates to an apparatus and method for building, erecting or suspending structures. In this specification the word structures is used to mean partitions and space divider panels, parts of portable buildings, shelving whether industrial or domestic, cupboards, bins, racks, shelves, desks, display units for use in retailing or at exhibitions or conferences. Such display units may be fitted or assembled units for dividing and using space. The structures referred to herein may be floor supported and free standing or suspended from a wall or ceiling or other suitable support. Such structures may be used for domestic, industrial or commercial applications. One important application of the invention is in the erection of "do-it-yourself" shelving and cupboards.

Purely for clarity of description, the invention will be particularly described primarily with reference to the erection of cupboards but it will be realised by those skilled in the art that the principles of the invention can readily be applied in any of the above-mentioned fields.

Systems are known in which strips or battens are screwed or otherwise fixed to a wall and prefabricated cupboards are fixed to the strips or battens. Disadvantages of such arrangements are that they usually require a skilled tradesman or carpenter to erect, that they may be costly in material, and that the resulting arrangement cannot be altered without rebuilding by a skilled artisan.

PRIOR ART

A cupboard construction system has been proposed in British Pat. No. 1,460,392 (Barget). This system includes vertical bars in which attachment blocks of special shape can slide, and tie bars which extend horizontally between the blocks and are screwed or clamped to them. The dimensions of the cupboard so built are determined by the length of the vertical and horizontal bars used, and so this system in the Applicants' opinion lacks versatility, and tends to be costly because of the variety of special shaped parts which must be used.

There have been numerous other attempts made to provide equipment for the construction of cupboards, cabinets and shelving, and many such systems have been offered for which claims have been made that erection is simple and easy and can be done by the average "do-it-yourself" practitioner. There have also been proposals for many different kinds of clips and brackets and corner joints which are stated to be useful in certain circumstances for attaching the various components parts of such systems to each other. The following patent documents are examples of various systems and equipment which have been proposed.

Elliott in British Pat. No. 593,433 published in 1947 suggested a frame building supported by uprights and horizontal members of metal of channel section. In order to inter-fit with certain panels, some of the channel section parts had flanges with recesses cut out therefrom. Walker in British Pat. No. 609,046 suggested a metal section and a clamp arrangement for securing panels to a wall which the panels were to cover. The Darling Company in British Pat. No. 796,854 suggested a shelf bracket of particular construction to co-operate with a vertical channel section upright. Wodli in 1958 in British Pat. No. 804,281 suggested an arrangement of corner connecting piece to join together furniture, panels or shelves. Holmquist in British Pat. No. 815686 discloses a bracket for supporting a shelf.

Clive in British Pat. No. 838,780 disclosed a shelf which rests on arms projecting forwardly from a supporting channel section member. Weber & Sohn in British Pat. No. 861,148 disclosed a relatively complicated channel section arrangement for fastening glass partitions in counters or display stands. A further suggestion on these lines was made by Mr. Weber himself in British Pat. No. 973,688. Compagnie Francaise Thompson Houston in French Patent Specification No. 1,366,000 published in 1964 disclosed an arrangement of parallel channel section support members, by the use of which a fitted kitchen could be constructed. Nicholls, in British Pat. No. 1,020,471 published in 1966, suggested particular designs of channel section metalware for use in assembling structures. The channel was particularly adapted to receive a flat nut which could slide therein to any desired position. Kuche and Haustechnik GmbH, in British Pat. No. 1,044,817, proposed cabinets which could readily be disassembled, made up from wooden walls or panels and support and fixing members of an elongate nature and specially chosen cross-sections. Proposals for knock down display and furniture units, particularly suitable for use in shops and supermarkets to display goods, and constructed by assembly of a number of interengaging or interlinking metals parts, were disclosed by Ready Metal Manufacturing Co. in British Pat. No. 1,064,978 and by J. A. Wilson Display Limited in Canadian Pat. No. 960,184. Courtney Pope British Pat. No. 1,070,391 disclosed an arrangement of shelves with special fittings to protect their front edges. Bremers in British Pat. No. 1,158,625 disclosed the assembly of adjustable frameworks from channel shaped members or struts, the sections being appropriately chosen so that a connection piece can be clamped to flanges of the channel section.

Baskind in British Pat. No. 1,170,906 disclosed a particular design of bracket for supporting a shelf from a vertical wall provided with suitable slots. An arrangement for mounting panels face to face over walls was disclosed by Ital-Bed Construzione Letti E Affini in British Pat. No. 1,241,980, published in 1971. For the building of furniture which can be put together without screws, rivets or welding, Gigante in British Pat. No. 1,348,416 disclosed an arrangement wherein certain limb projections snap into associated cross-rack members. An elongate member with a special profile is suggested for attaching a cover. The same inventor in British Pat. No. 1,350,394 disclosed numerous component members of a system for building furniture, all fitted together by simple form locking engagement.

Dobson in British Pat. No. 1,386,409 disclosed the use of a particular channel section as a display frame. Fink in U.S. Pat. No. 3,362,768 (1968) disclosed the building of a cabinet system using elongated support members bolted to a wall. Torok in U.S. Pat. No. 3,480,345 discloses inter-fitting sheets, plates, and bent metal items in order to provide a composite space defining structure, for example a partition with a shelf extending therefrom. British Stell Corporation in U.K. Patent Application No. 2,019,479A (published 1979) disclose a system for interconnecting cladding panels in prefabricated buildings.

Gray in U.S. Pat. No. 4,193,650 suggested a cabinet which can be assembled and in which the internal dividing shelves and partitions can be readily inserted in any one of many selected positions, as desired. Amco Engineering in U.K. Patent Application 2,095,101A disclosed a knock down enclosure particularly for electronic components and a method of assembling such an enclosure, using channel section members and bolting them together.

A wide variety of channel section members have been proposed for various purposes. As well as the various channel section members shown in the patents mentioned above, other suggestions are to be found, for example, in the following British Patents:

545,200; 609,046; 753,081; 765,986; 1,044,817; 1,070,391; 1,158,625; 1,241,980.

SUMMARY OF THE INVENTION

It is an aim of the present invention to provide an apparatus and a method for building erecting or suspending structures which is easy to use, which is versatile in application, which provides a durable product of good load bearing capability, and which offers a saving in material and a saving in installation costs.

In its broadest aspect, the present invention provides apparatus for building, erecting or suspending structures including an elongate linear support member and a panel wherein the panel is releasably attached to the support member utilizing a "lift and rotate" assembly procedure, suitable parts on the panel or on a bracket fixed thereto being capable of inter-engaging with the support member.

PREFERRED EMBODIMENTS OF THE INVENTION

Also according to the invention, there is provided apparatus for building, erecting or suspending structures including an elongate linear support member, said member having a vertical web and a horizontal web, the vertical web being provided with a horizontally extending flange, the linear support member being constructed to co-operate with a panel intended to hang substantially vertical from the support member with its plane substantially perpendicular to the length of the support member, in which the apparatus includes an engaging means between the upper edge of the panel and the support member and arranged to preclude horizontal separation of the panel and the support member once they are assembled together as hereinafter stated, and in which the panel has a notch in its inner edge, the notch being positioned and dimensioned to receive the said flange to provide vertical support for the panel when the panel is presented to and hung from the support member.

In accordance with one embodiment of the invention, the elongate support member also has a substantially vertically and downwardly extending flange which extends from its horizontal web, and the upper edge of the panel has therein a notch dimensioned and positioned to be entered by the flange and to serve to prevent horizontal separation of the panel from the member once they are assembled by a procedure herein called a "lift and rotate" procedure:the notch in the upper panel edge is preferably of decreasing width and is defined by a vertical surface and a curved or inclined surface, the vertical surface being located nearer to the panel inner (or rear) edge (when the panel and the support member are assembled) than the former. In this embodiment the two notches are located near to what will be the top inner corner of the panel when it is suspended from the linear support member; for brevity of description this corner is herein referred to as the support corner. This construction allows the panel to be hung by a simple procedure in which the panel is presented manually to the support member, held substantially vertical with its support corner slightly lower than its other top corner. The top surface notch is then brought adjacent the downwardly extending flange and the panel is lifted so that this flange partly enters the notch. Simultaneously, the panel (still in a substantially vertical plane) is rotated slightly about an axis perpendicular to its plane, so that the horizontally extending flange enters te notch in the inner edge of the panel. This rotation movement of the panel is continued until the panel inner edge is vertical and both flanges are fully seated in their respective notches. In this position the panel is stably and firmly supported by the linear support member. Shelves can then if desired be supported by an adjacent pair of panels which are themselves supported by a single horizontal elongate support member in this way. In this way, shelves can be supported by a single member, leading to simplicity of installation and a saving in material.

It will be seen that the downwardly extending flange and the notch in the top edge of the panel together constitute an engaging means which, when the panel is assembled to the support member, precludes relative substantially horizontal movement therebetween.

In one particular version of this embodiment of the invention the elongate support member has a horizontal web and a vertical web, the horizontal web has a flange at its edge further from the vertical web, and the vertical web has a flange extending horizontally away from the vertical web for a distance of under one quarter of the distance which the horizontal web extends therefrom.

In this specification, the words horizontal and vertical are not used in a strict geometrical sense, they are used to mean "substantially vertical" and "substantially horizontal" since it will be apparent to a practical man that all or most of the advantages of the invention can be obtained when the relevant parts referred to depart by a small amount, e.g. a few degrees from the strict vertical and horizontal.

In another embodiment of the invention, the elongate support member has a horizontally-extending flange, and the panel has a notch in its inner edge, as previously described, and the engaging means is constituted by the co-operation of a pin or peg with a co-operating hole or blind hole. The pin or peg may for example extend upwardly from the top edge of the panel and may (when the panel is assembled to the elongate support member) extend into a hole in the horizontal web of the support member. Alternatively, the support member may have a pin extending downwardly from its horizontal web and this pin may extend into a blind hole in the top edge of the panel when the panel is assembled with the support member. As an alternative to or in addition to the embodiment just described, the engagement between the vertical edge of the panel and the elongate support member may be constituted by the co-operation of a pin or peg with a complementary hole or blind hole. Other mechanical engagements for achieving the stated purpose may be equally suitable. With this arrangement, the previously described simple "lift and rotate" hanging procedure may equally well be employed. The panel notch and the engaging means may be, but need not necessarily be, on or in the material of the panel. As an alternative, they could be in a corner fitting or attachment fixed to the relevant corner of the panel.

Also according to the invention, there is provided a method of erecting a structure defining a space whose sides are formed by a pair of vertical panels, the method comprising the steps of securing, to a wall or other support, an elongate support member as defined herein, providing a pair of panels each having notches positioned to co-operate with the flanges of the support member, and hanging each panel of the pair from the support member.

BRIEF DESCRIPTION OF THE FIGURES OF THE DRAWINGS

The invention will be better understood from the following non-limiting description of embodiments thereof given with reference to the accompanying drawings in which:

FIG. 14 being a front view of a rail co-operating with an end plug and an end wall of a cupboard; and FIG. 15 being a perspective view of upper and lower rails co-operating with a cabinet end wall.

FIG. 17 being a front view of a wall cabinet that can be erected using the rails shown in FIG. 15; and FIGS. 18 and 19 are respectively a cross-section taken in a vertical plane of a cupboard erected using one embodiment of apparatus according to the invention; and a back view showing a series of laterally-adjacent cupboards of the kind shown in FIG. 18.

SPECIFIC DESCRIPTION OF EMBODIMENTS OF THE INVENTION

Figure 2:
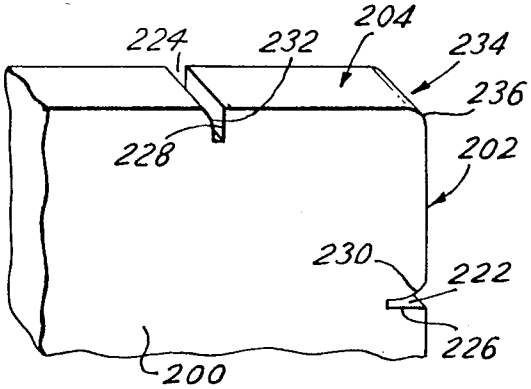
FIG. 2 is a perspective view showing, diagrammatically and not to scale, a corner of one example of panel which can be used in apparatus according to the invention.
Figure 1:
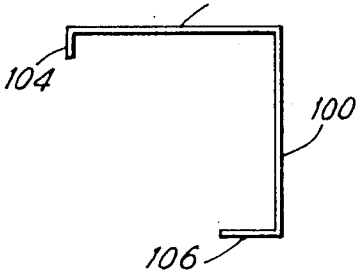
FIG. 1 is a cross-section taken in vertical plane of an example of an elongate linear support member for use in apparatus according to the invention.
Figure 3:
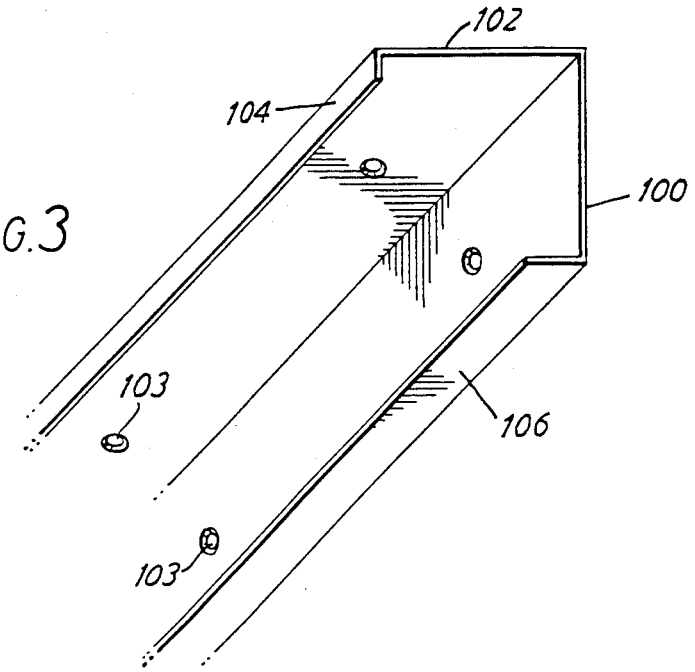
FIG. 3 is a perspective view of the support member illustrated in FIG. 1.

Referring firstly to FIGS. 1–3, the illustrated elongate linear support member (rail) is usually made of metal and includes a first web 100 and a second web 102 which form an L-shaped cross-section. The vertically extending web 100 has a horizontal flange 106 extending therefrom, and the horizontally extending web 102 has a vertically downwardly extending flange 104. Vertical flange 104 is disposed at the edge of horizontal web 102 distal to vertical web 100. Horizontal flange 106 is disposed at the edge of vertical web 100 distal to horizontal web 104. The flanges 104 and 106 extend continuously over the full length of the elongate member. At suitable intervals, holes 103 are provided in the respective webs 100, 102. The holes 103 in the web 100 permit the support member to be fixed to a vertical wall, and the holes 103 in the web 102 permit the support member to be fixed to a ceiling or a roof beam.

FIG. 2 illustrates a corner of a panel 200, the panel having a rear or "inner" edge 202 and a top edge 204. An inner edge notch 222 is provided across the whole thickness of the panel in the edge 202, and a top edge notch 224 is provided in the top edge of the panel as illustrated. Each such notch is defined by a straight surface 226 or 228 and curved, inclined or chamfered surfaces 230,232. Inner edge notch 222 has a straight horizontal surface 226 distal to top edge 204 and a curved, inclined or chamfered surface 230 closer than surface 226 to top edge 204. Top edge notch 224 has a curved, inclined or chamfered surface 232 distal to inner edge 202 and a straight vertical surface 228 closer than surface 232 to inner edge 202. The corner 234 of the panel is chamfered or radiused as indicated at 236. This construction is to facilitate the hanging of the panel 200 from the rail shown in FIGS. 1 and 3.

To carry out this suspension, the panel 200 is held approximately vertically and is presented to the rail. It is initially held with the corner 234 slightly lower than the other end of the top edge 204, and the panel is lifted until the flange 104 is received in the notch 224. The panel is then rotated about an axis perpendicular to its plane, so causing the flange 106 to enter the recess 226. When the panel reaches its normal hanging vertical position, the flange 106 of the rail extends into the notch 222 and the flange 104 of the rail extends into the notch 224. The flange surfaces are in respective contact with load-bearing surfaces 230 and 232. Due to the narrowing at the bottom of each notch 224, 222, the panel is firmly and stably held in its suspended position.

Shelves may be placed between two adjacent vertical panels 200, or two such panels may constitute the end walls of a cupboard or cabinet.

Figure 4:
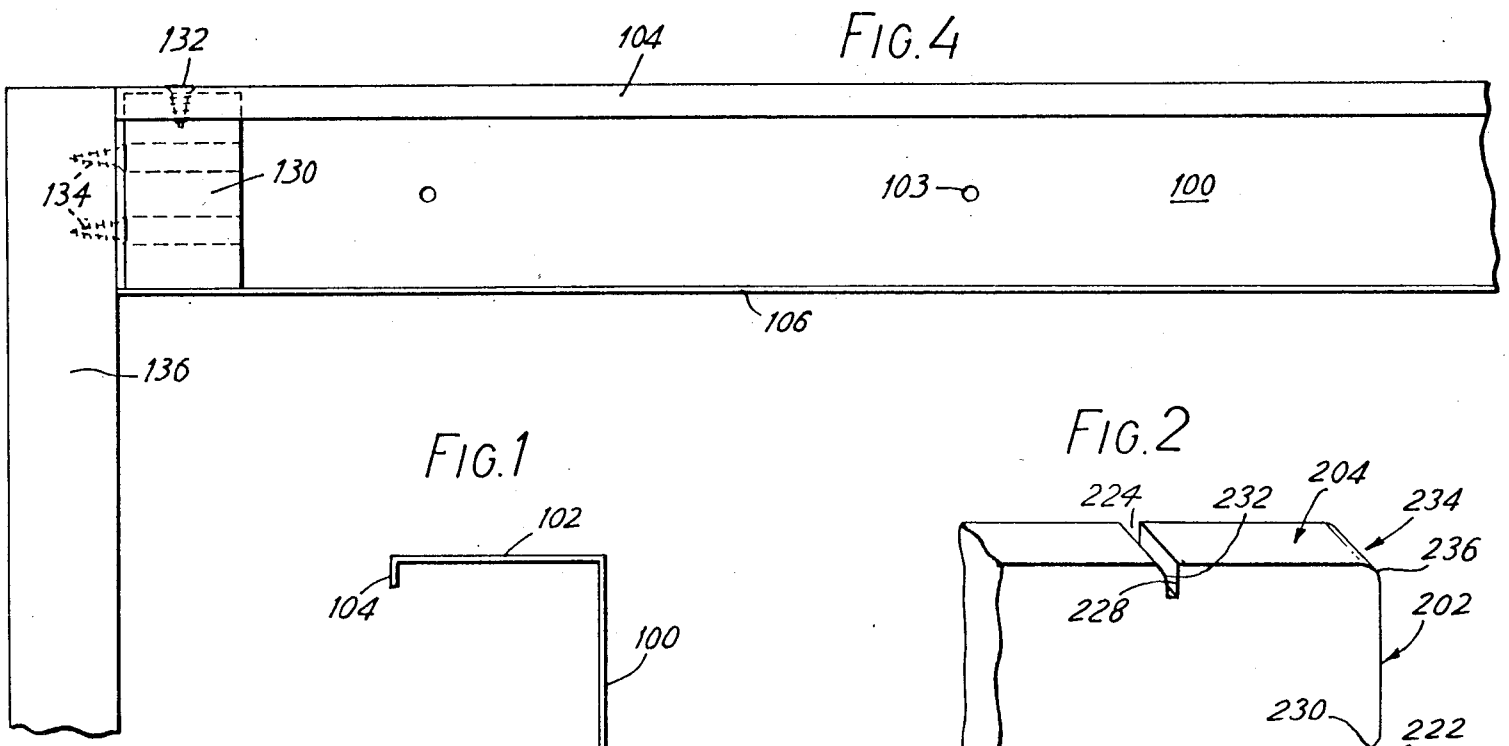
FIG. 4 is a front elevation showing an end panel connected to an elongate support member of the kind shown in FIGS. 1 and 3 by a connection block.

FIG. 4 illustrates a different construction for an end wall 136, this being secured at the end of an elongate linear support member 100 by an inserted block 130. The end wall or panel 136 has the block 130 attached thereto by a pair of screws 134, and the block 130 is maintained in position relative to the support member 100 by a screw 132 extending through a suitable hole 103. During installation, it is merely necessary to ensure that the elongate linear support member 100 is truly horizontal, and is firmly screwed to the wall. Once this is done, panels 200 can be suspended therefrom as needed, and these panels may extend to floor level if desired, or alternatively may themselves serve as supports for shelves or for a floor and door structure defining a cupboard. Consequently it is possible for shelves, cupboards or other structures to be very easily and simply erected and assembled, without the use of craft skills, and by relatively unskilled persons.

Figure 5:
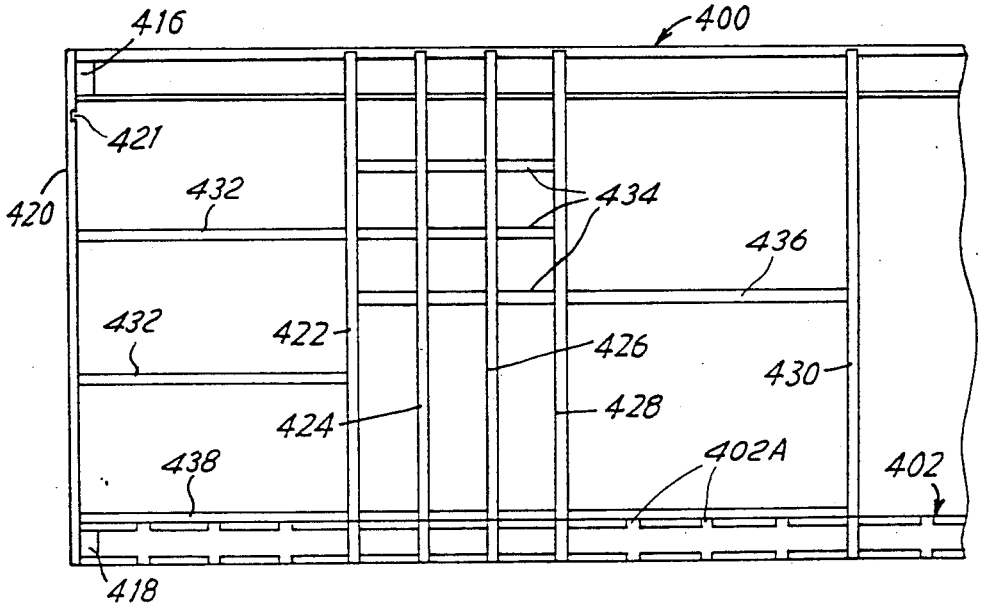
FIG. 5 illustrates a wall-hung shelf unit that can be constructed utilizing the present invention.

FIG. 5 shows an elongate linear support member 400 (of the type shown in FIGS. 1 and 3) and an elongate linear lower fixing member 402 of any suitable design. The member 402 is not essential to the invention and can be omitted provided that the practical requirements of location and stabilisation of the bottom edges of the panels are met by other suitable means. If it is included, it may be used for fixing the bottom of the structure to the wall or it may assist in carrying the load of the structure and any contents placed thereon. End plugs 416 and 418 are disposed in each end of the members 400,402 and have respective end panels screwed thereto. One end panel is shown at 420. The end panel 420 may have a horizontal groove 421 for receiving the roof of a cupboard, if desired. Intervening vertical panels 422, 424, 426, 428 and 430 are suspended from the support member 400 at any chosen position along its length and serve to divide the cabinet as may be desired. The intervening panels have the inner top corner configuration which has been described with reference to FIGS. 2 or 7 and are suspended from the member 400. The panels 422–430 also support shelves 432 which may serve to define a bookcase portion, shelves 434 which may define a wine rack portion, and shelf 436 which may define a glassware portion. The cupboard bottom 438 is also supported by the end panels and optionally also by the member 402 (if present) or by one or more of the intervening panels. It will be appreciated that the intervening panels 422–430 are located in chosen positions as defined by recesses 402A in the member 402 (if present).

Figure 6:
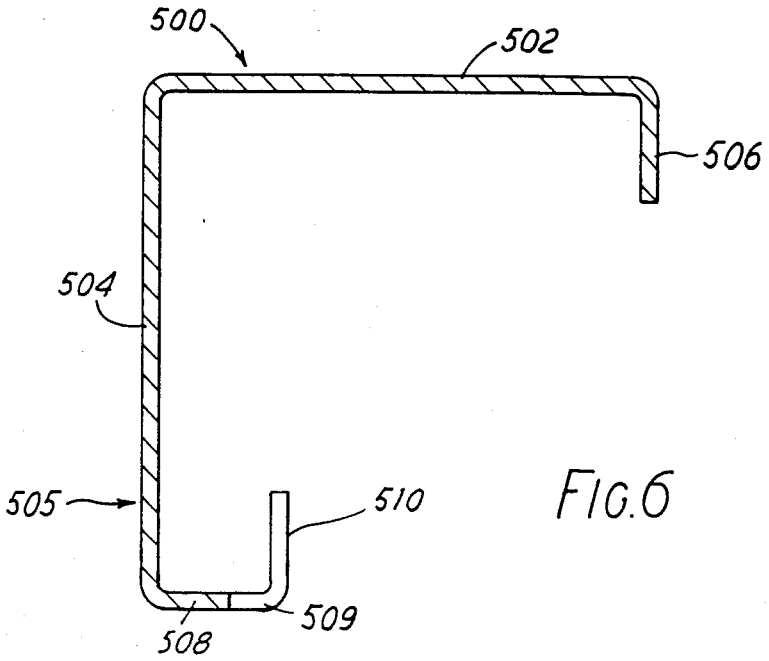
FIG. 6 shows, in vertical cross-section, one particular embodiment of linear elongate support member for use in the invention.

The elongate linear support member 500 shown in FIG. 6 differs from that shown in FIGS. 1, 3 and 4 in that it has spaced upwardly extending lugs as will shortly be described. The elongate support member 500 has an L-shaped cross section including a horizontal web 502 and a vertical web 504. A continuous flange 506 extends vertically downwardly from the web 502 and a continuous flange 508 extends horizontally from a lower region of the web 504. At spaced intervals, preferably at equally spaced intervals, the flange 508 has portions 509 which each extend outwardly and carry upstanding lugs 510. The purpose of these flange portions 509 and lugs 510 is to define recesses or "cut outs" in the flange 508 which each receive and locate the inner edge of a respective panel which is to be suspended from the elongate support member 500. In contrast, the flange 506 is continuous and of uniform height along its length.

Figure 7:
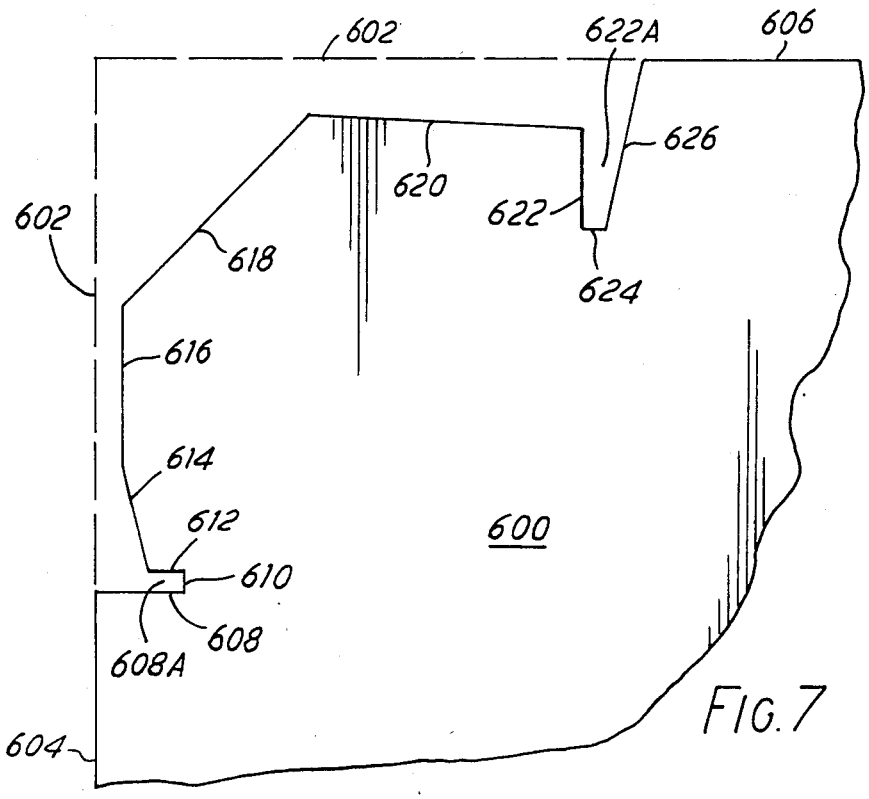
FIG. 7 shows one particular and preferred configuration of panel for use with the support member shown in FIG. 6, the corner part only of the panel being shown.

FIG. 7 illustrates the top inner corner of a panel 600 according to the invention. The panel is basically rectangular and the dotted construction line 602 (which does not represent the edge of the panel) shows the boundaries of the rectangle. The panel 600 is defined by an inner edge 604 and an upper edge 606. The corner region of the panel is defined by edge portions 608–626 of which portions 608–612 define a slot 608A whose function corresponds to that of the slot 222 in the panel 204 of FIG. 2. Edge portions 622–626 define a slot 622A whose function corresponds to the slot 224 of FIG. 2. The depth (measured inwardly perpendicular to the edge 604) of the slot 608A is substantially equal to or slightly greater than the inward extension of the flange 508 measured from the surface 505. The depth of the slot 622A, measured perpendicular to the edge 606 is greater than the height of the flange 506. It may for example be from about 120–150% of the said height.

Figure 8:
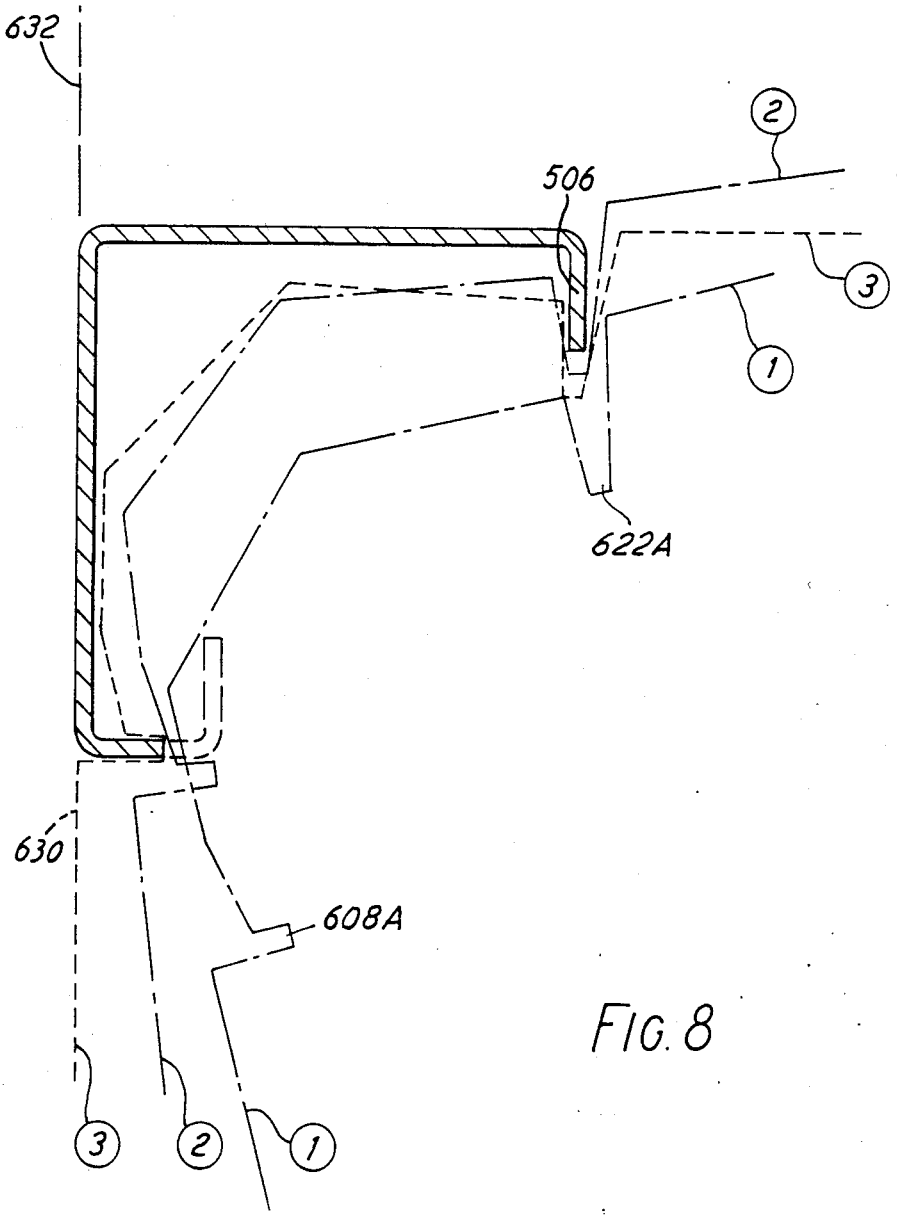
FIG. 8 shows stages in the assembly of the panel and support member according to FIGS. 6 and 7.

The suspension of the panel 600 from the linear elongate member 500 can readily be understood from FIG. 8. The panel 600 is held generally vertical and is presented to the member 500 in the orientation indicated by the circled numeral 1, and is then lifted until the flange 506 enters the slot 622A. The panel is then rotated clockwise as seen in the drawing, while the plane of the panel is maintained vertical or close to vertical. The panel in this movement moves through the position shown by circled numeral 2, and thereafter is lifted slightly and the rotation continued so that the panel reaches the position indicated by the circled 3. In this position its inner edge 630 (FIG. 8) below the slot 608A is substantially in contact with the face of the wall 632, the flange 508 is fully entered into the slot 608A so precluding downward movement of the panel, and the flange 506 is fully engaged in the slot 622A, so precluding any horizontal movement of the panel away from the wall.

A pair of panels can be firmly supported in this way by unskilled persons, using only a single rail, and can be used to support shelves or doors or any other desired units or fittings.

Figure 9:
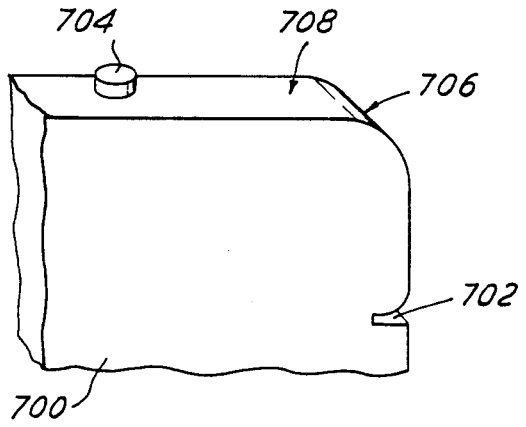
FIGS. 9 and 10 illustrate another embodiment of the invention.

An alternative embodiment of panel for use in the invention is illustrated in FIG. 9.

The panel 700 illustrated in FIG. 9 has a slot 702 in its inner edge similar in construction and function to the slot 608A of FIG. 7 and the slot 222 of FIG. 2. However, the panel 700 does not have any slot in its top edge; instead, a cylindrical pin extends upwardly therefrom, the pin being shown at 704. The upper top corner of the panel 700 is radiused or chamfered as indicated at 706. The purpose of the upstanding cylindrical pin 704 is to engage in a corresponding circular hole 503 in the flange 502 of the elongate support member (FIG. 10), in order to preclude horizontal movement of the panel away from the support member once the flange 508 is fully engaged in slot 702. It will be realised that the pin 704 and its co-operating circular aperture in the web 502 constitute engaging means similar in function to the slot 622A and the flange 506, FIGS. 6 and 7. It will be appreciated that the pin need not be cylindrical nor need the hole be circular; for example a pin or lug could have a rectangular or oval cross-section to be complementary to a hole of like cross-section in a web of an elongate support member.

It will readily be realised that in an alternative construction, the upper edge 708 could be provided with a blind cylindrical recess, and a downwardly extending circular pin or stud, dimensioned to be received in such a recess, would be provided on the web 502. Other mechanical variants may occur to a man of average skill in the art, and may be applied to the vertical edge or the horizontal upper edge of the panel.

Figure 10:
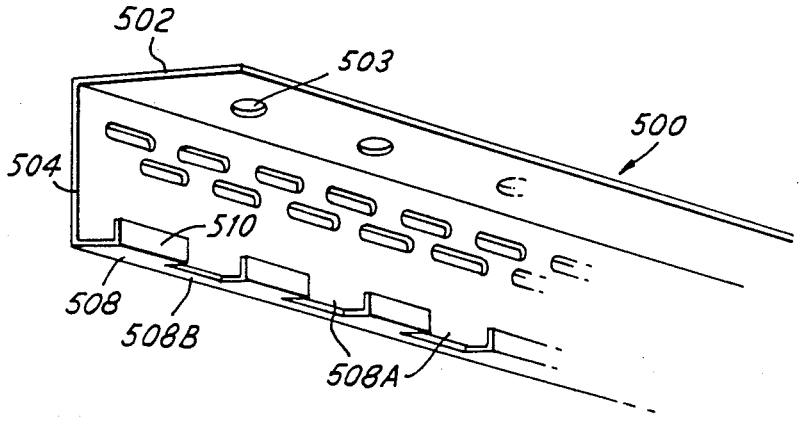

The elongate support member illustrated in FIG. 10 has a horizontal web 502, a vertical web 504, and a flange 508 extending from the web 504. Upturned lugs 510 extend from the flanges 508. The flange 508 is of castellated shape and defines equally spaced recesses 508A whose length in the direction of the length of the support member is slightly greater than the width of a panel. Holes 503 in the web 502 are located above the mid-points of the respective recesses 508A, and are each intended to receive an upstanding pin or lug (such as 704, FIG. 9) on a panel. An assembled panel has its inner or rear edge inserted into a chosen recess 508A, the portion 508B of the flange 508 thereat extends into the confronting panel notch, and the pin or lug on the panel upper edge extends into the hole 503 corresponding to the chosen recess. In this way, the panel is securely suspended from the elongate support member. The lugs 510 serve as spacers, but are not essential.

Figure 11:
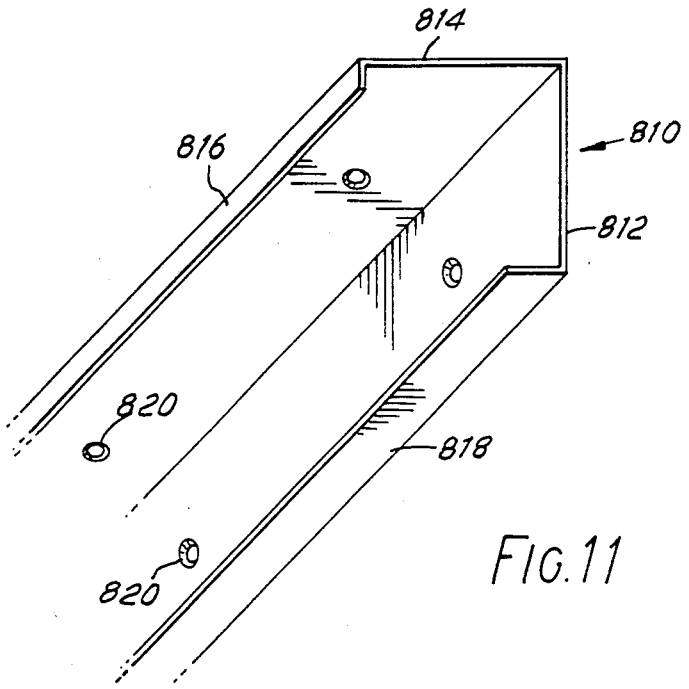
FIGS. 11, 12, 13, 14 and 15 illustrate various forms of rail which may be employed in the practice of the present invention, FIGS. 11 and 12 being perspective views of different forms of rails, FIG. 13 being a cross-sectional view of another rail.

FIG. 11 illustrates one example of an elongate L-shaped support member or rail 810, having a vertical web 812 and a horizontal web 814. A horizontal flange 816 extends downwardly in a vertical direction from the distal end of the web 814, and a flange 818 extends horizontally from the lower end of the web 812. The webs 812 and 814 have holes 820 therein so that the rail can be attached, as desired, either to a wall by screwing or bolting using the holes in the web 812, or to a ceiling or other overhead support by using the holes in the web 814. While shown as circular, the holes 820 may be elongated slots to allow adjustment of the longitudinal position of the rail 810 on the wall or ceiling. Although as shown in FIG. 11 the width (horizontal extent) of the flange 818 is just under $\frac{1}{3}$ of that of the web 814, it is preferred that the width of the flange 818 should be under $\frac{1}{4}$ of that of the web 818.

Figure 12:
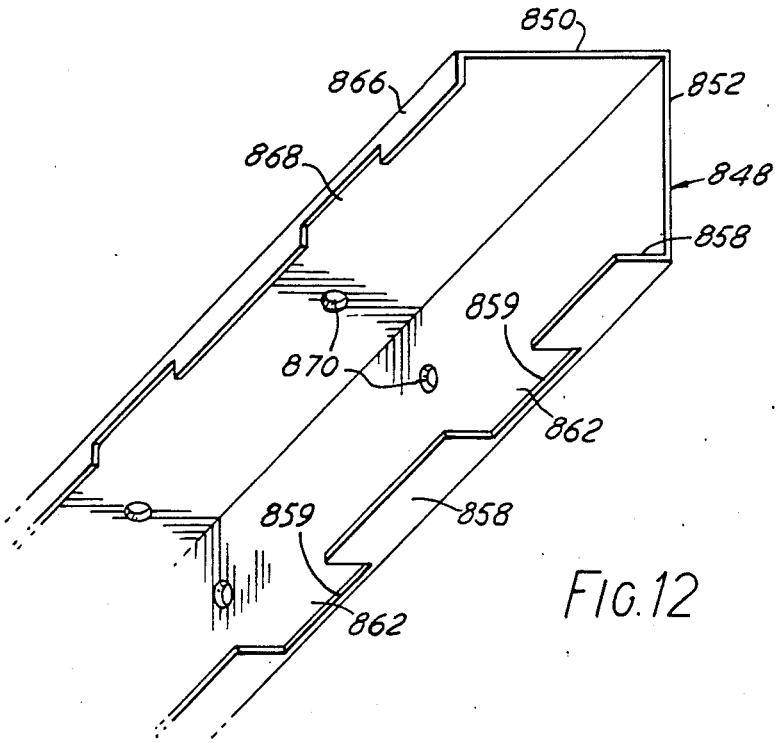

FIG. 12 illustrates an alternative embodiment of elongate L-shaped support member or rail 848, having a horizontal web 850 and a vertical web 852. A horizontal flange 858 extends from the lower edge of the web 852 and there are cut-outs 862 at regular spaced intervals along the flange 858. The inner edge of each of these cut-outs is seen at 859. A flange 866 extends vertically downward from the distal edge of the horizontal web 850, and this flange has rectangular cut-outs 868 which are spaced correspondingly to the recesses or cut-outs 862. The purpose of the recesses 862, 868 is to receive and locate a panel, which is to be suspended from the rail 848 in a manner using the "lift and rotate" procedure described earlier. Screw holes 870 are provided for the same purpose as the holes 820 of FIG. 11.

Figure 13:
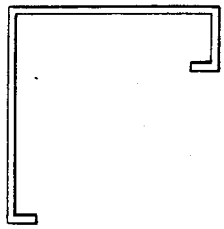

FIG. 13 is a cross section illustrating a modified rail somewhat similar to the rail of FIG. 6, but continuous, i.e. un-notched.

Figure 14:
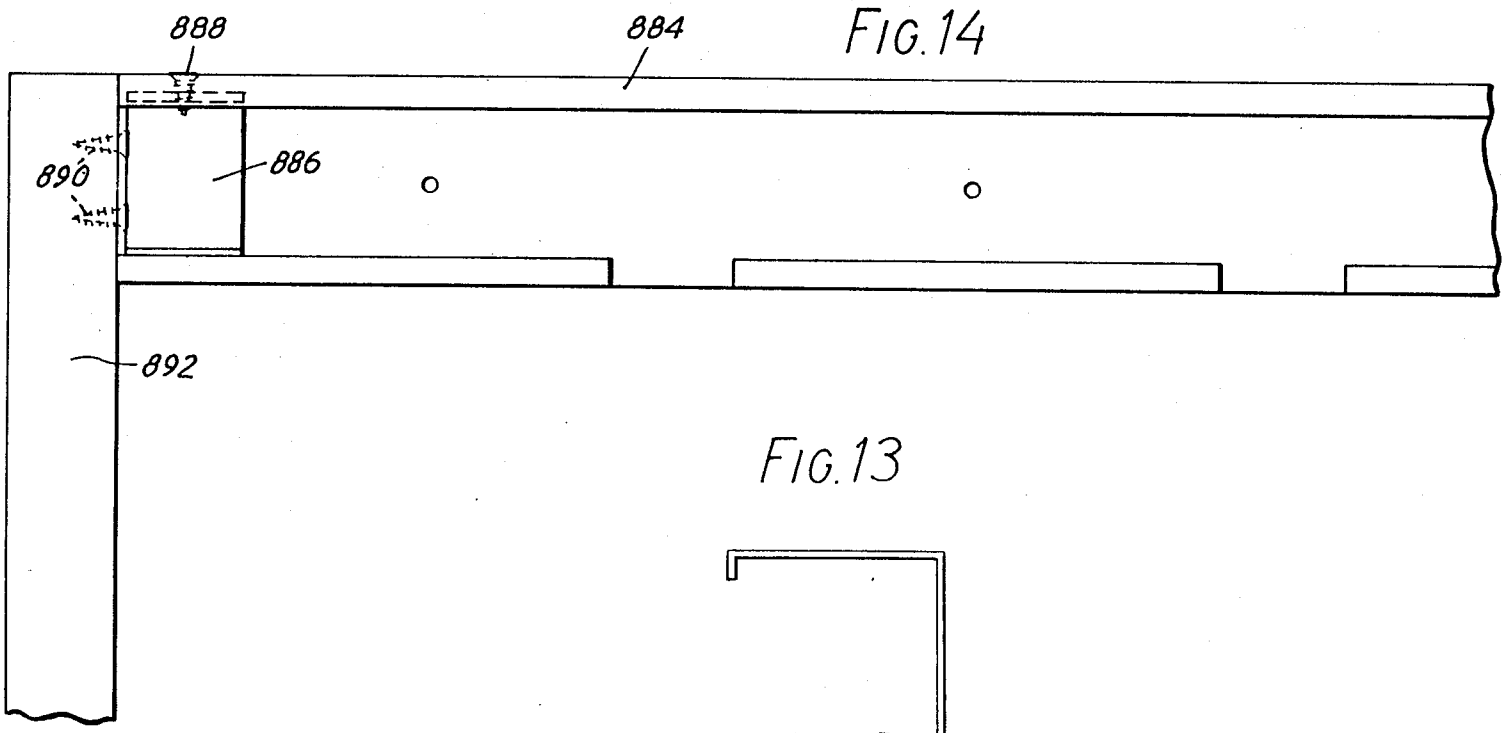

FIG. 14 shows an upper front rail 884 used to partly support a cupboard, looking forwardly from inside the cupboard, and illustrating the arrangement at the end of the rail. A plug 886 is placed in the end of the rail 884 and is shaped to make a snug fit therein. It is secured therein by a screw 888 passing through a horizontal web of the rail and screws 890 extending into an end support panel 892 which forms the end wall of a single cupboard or a line of cupboards. The plug 886 may for example be rectangular in section.

Figure 15:
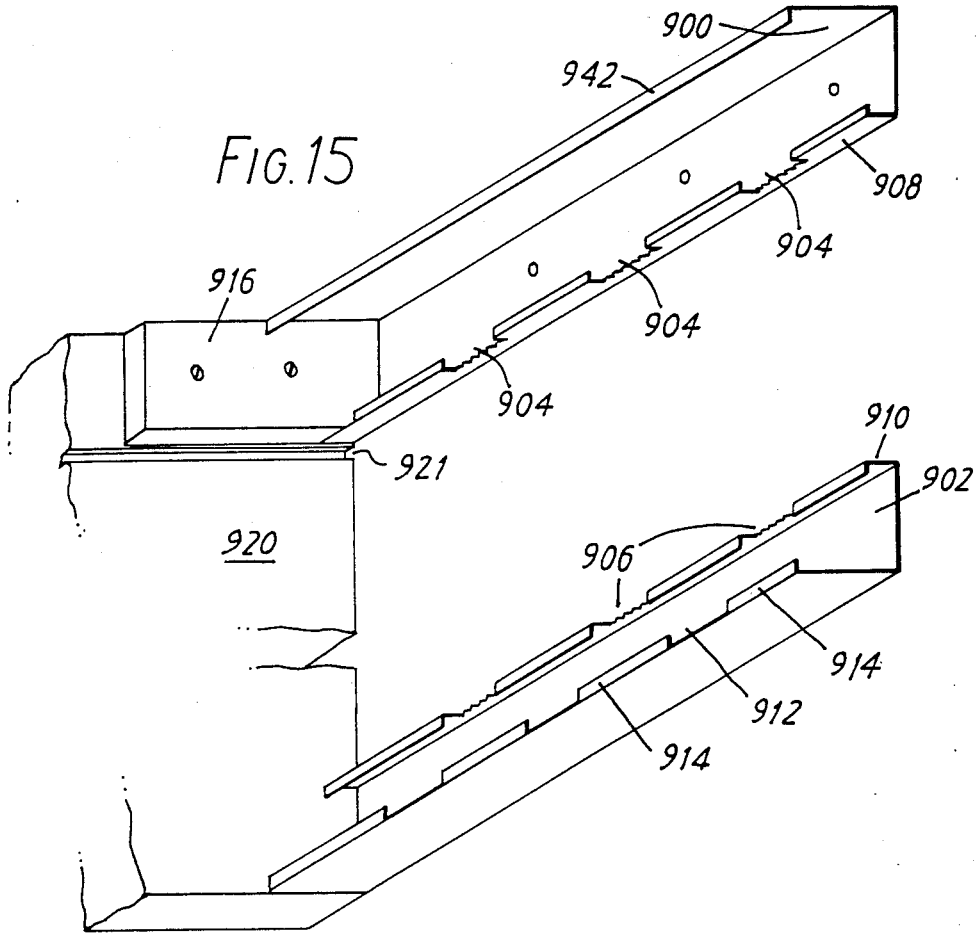

FIG. 15 shows an elongate linear upper support member or rail 900 and an elongate linear lower support member or rail 902 used to support panels of a cabinet. These have respective recesses 904 and 906 in their horizontal flanges 908 and 910 and the lower rail also has recesses 912 in its upstanding flange 914. The recesses are regularly and equally spaced along the length of the rails, so facilitating positioning of panels. End plugs, one shown at 916, are disposed in each end of the rails 900, 902 and support respective end panels, one shown at 920. The end panel 920 has a horizontal slot 921 for receiving the roof of a cupboard, if desired. Intervening vertical panels may be located in selected aligned recesses and serve to divide the cabinet as may be desired. The panel 920 and an intervening panel may support shelves if desired.

Figure 16:
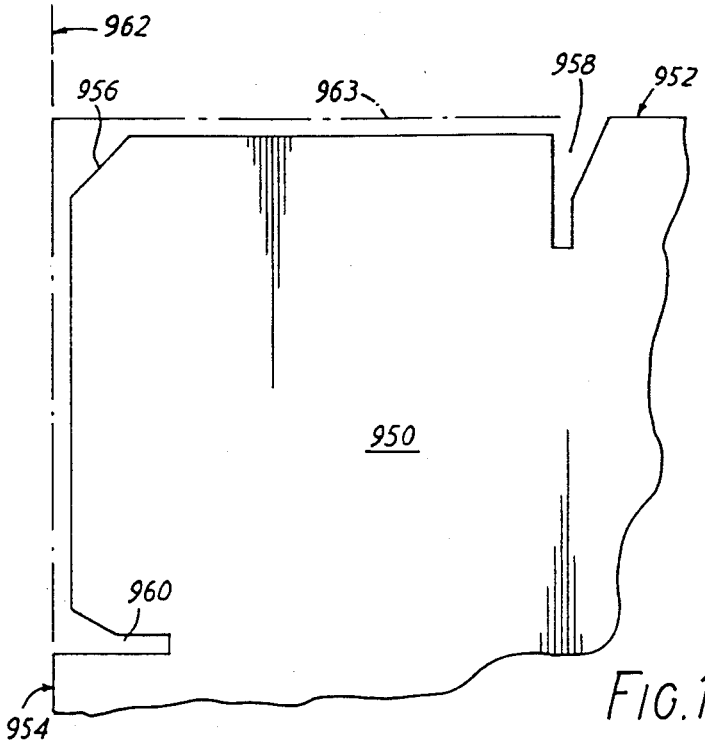
FIG. 16 illustrates an upper corner region of a panel usable in the invention.

FIG. 16 diagrammatically illustrates a portion of a panel 950 intended for use with a suitably dimensioned rail according to FIG. 11. The panel 950 is substantially rectangular in shape and has a top edge 952 and an inner vertical edge 954. Its top corner is chamfered as shown at 956, and as an alternative this could be radiused. The panel has a vertically downwardly extending slot 958 and a horizontally inwardly extending slot 960, these slots being dimensioned and positioned respectively to receive the flanges 816 and 818 of the rail of FIG. 11. In assembling the panel with the rail 810 the "lift and rotate" procedure described previously is employed. The surface of a wall upon which the rail is fixed is shown at 962 in FIG. 16. The rectangular outline of the panel prior to the profiling of its upper inner corner is indicated at 963.

Figure 17:
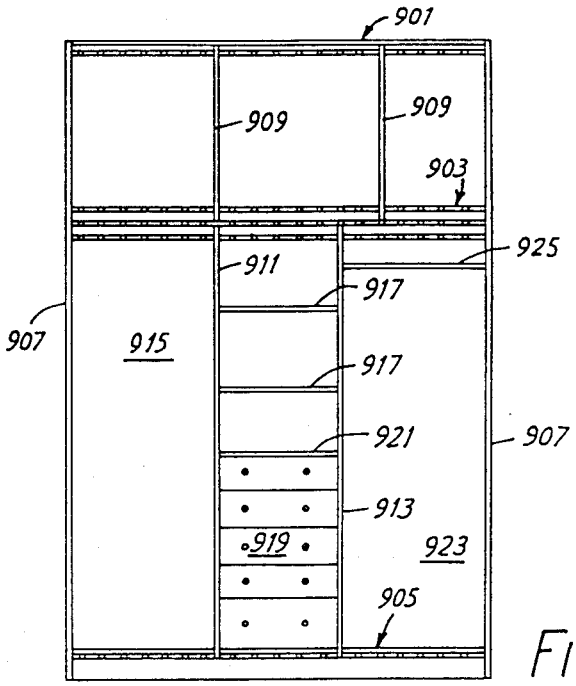
FIGS. 17–19 illustrate various structures that can be made using the principles of the invention.

FIG. 17 illustrates a floor-standing composite item of furniture made up from an upper rail or support member 901, and intervening rail 903, and a floor rail 905. End panels 907 are attached to the support members in the manner illustrated in FIG. 14, using plugs corresponding to plug 886, FIG. 14, and divider panels 909 divide the upper region into three cupboards or compartments while divider panels 911, 913 divide the lower part of the item into a wardrobe cupboard 915, a shelf section having shelves 917, and a five drawer section 919 whose upper surface 921 serves as the lowermost shelf. The right hand part of the unit is constituted by a tall cupboard 923 and a hat shelf 925. The divider panels 907, 909, 911 and 913 are all connected to and supported by the rail 901 using the principles described in the preceding description.

An important advantage of furniture as particularly described with reference to FIG. 17 is that a saving in material can be achieved, in that no back panel of the cupboard is needed, since the adjacent wall can serve as the cupboard rear boundary; and also since the divider panels serve as structural members and support (in conjunction with the upper and lower front rails) the cupboard door, no forwardly-extending beams are needed for this purpose.

It will be appreciated that numerous variations can be made within the concept of this invention, and the composite furniture unit illustrated in FIG. 17 is only one of a very large number of possible configurations of cupboards, drawers, racking, bins, shelving etc. which can be constructed using the apparatus and method of the present invention. Moreover, construction is not difficult and can easily be carried out by the "do it yourself" enthusiast or by unskilled personnel. Once an upper horizontal rail is correctly secured to a wall or ceiling then the rest of the structure can be readily assembled without the use of any special craft skills. Moreover, according to an optional refinement of the invention, each rail can incorporate or have secured to it a small spirit level so that placing these members with their length horizontal can be done without undue difficulty.

It will be realised that the apparatus particularly disclosed herein for erecting cupboards, etc., can be used for erecting a portable building or cabin by increasing the size of the parts.

Figure 18:
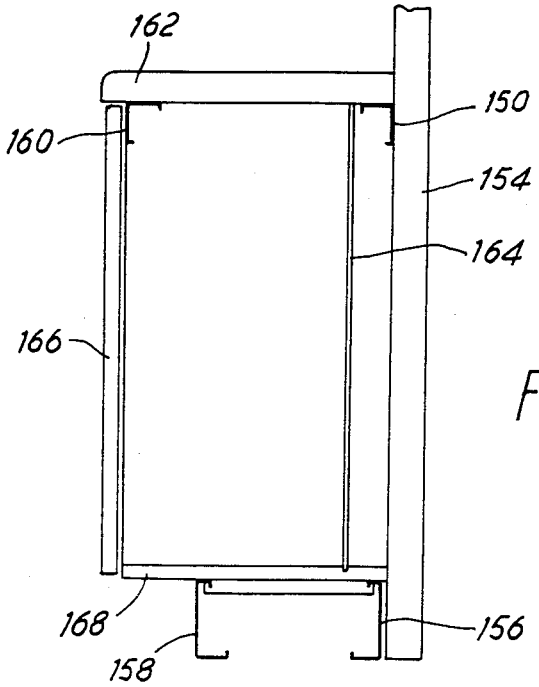
Figure 19:
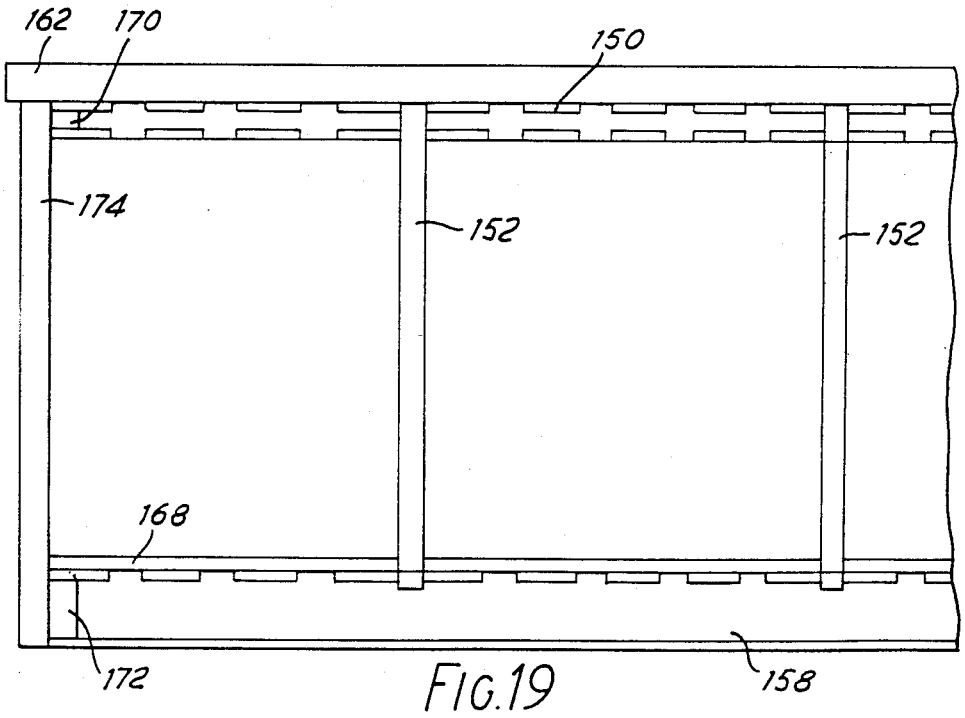

FIGS. 18 and 19 illustrate one use of the apparatus according to the invention.

FIG. 18 is a cross-section taken in a vertical plane of a cupboard erected using apparatus according to the invention, namely utilising an elongate L-shaped support member or rail 150 and panels 152. In FIG. 19, a series of cupboards are illustrated as supported by the rail 150 which is bolted, screwed or otherwise fixed to a wall 154. The rail 150 supports the panels 152 in the manner previously described. The cupboard is also partly supported by lower rails 156, 158 and has a top front rail 160. These rails are elongate linear relatively rigid members and preferably are metal sections. The illustrated cupboard has its roof formed by a worktop 162, and has a back panel 164, a door 166 and a floor 168. The floor 168 is also supported by the bottom rail 158. The rails 156 and 158 may rest on the floor of the room. End plugs 170 and 172 (FIG. 19) assist in connecting an end panel 174 to the structure. The door 166, the upper front rail 160, and the back panel 164 are not shown in FIG. 19, which is the view looking inside the cupboards towards their rear.

It will be appreciated that modifications may be made without departing from the scope of the invention. For example, while it has been mentioned that the rails may be made of metal, they could also be made of other suitable material. The precise dimensions of the webs and flanges are of course subject to variation according to the application. While certain particular preferred profiles of panel upper corner have been illustrated in FIGS. 7, 9 and 16 other profiles which mate appropriately with the associated rail to provide a strong and secure attachment could be employed.

I claim:

1. An apparatus for building, erecting or suspending structures comprising:

(i) an elongated linear support member formed by a vertical web and a horizontal web, said vertical web having a horizontally extending flange and said horizontal web having a downwardly extending vertical flange; and (ii) a panel configured and dimensioned to cooperate with said linear support member so that said panel hangs substantially vertically from said linear support member with the plane of said panel substantially perpendicular to the length of said linear support, (a) said panel having a top edge provided with a top edge notch configured and dimensioned to receive said vertical flange when said panel and said elongated linear support member are assembled, thereby preventing horizontal separation of said panel from said elongated linear support member, (b) said panel also having an inner edge provided with an inner edge notch defined by a lower horizontal straight surface distal to said top edge of said panel and an upper, inclined surface nearer than said lower horizontal surface to said top edge, such that said inner edge notch is configured and dimensioned to receive said horizontal flange when said panel and said elongated support member are assembled, thereby providing vertical support for said panel.

2. The apparatus according to claim 1 wherein said top edge notch is further defined by a curved surface distal to said inner panel edge and a straight vertical surface nearer than said curved surface to said inner panel edge.

3. The apparatus according to claim 1 wherein said top edge notch is further defined by a top edge notch inclined surface distal to said inner panel edge and a straight vertical surface nearer than said top edge notch inclined surface to said inner panel edge.

4. The apparatus according to claim 1 wherein said vertical flange is disposed at the edge of said horizontal web distal to said vertical web and said horizontal flange is disposed at the edge of said vertical web distal to said horizontal web, said horizontal flange extending from said vertical web for a distance equal to less than one quarter the distance between said vertical web and said vertical flange.

5. An apparatus for building, erecting or suspending structures comprising:

(i) an elongated linear support member having a vertical web and a horizontal web, said vertical web being provided with a horizontally extending flange and said horizontal web being provided with a downwardly extending vertical flange;

(ii) a panel configured and dimensioned to cooperate with said elongated linear support member so that said panel hangs substantially vertically from said support member with the plane of said panel substantially perpendicular to the length of said linear support member, said panel having a top edge and an inner edge, said inner edge being provided with an inner edge notch having a horizontal straight surface distal to said top edge and an inner edge notch curved surface nearer than said horizontal straight surface to said top edge, said inner edge notch being configured and dimensioned to receive said horizontal flange on said elongated linear support member and provide vertical support for said panel when said panel and said elongated linear support member are assembled; and (iii) engaging means between said top panel edge and said elongated linear support member including a top edge notch provided in said top panel edge configured and dimensioned to receive said downwardly extending vertical flange when said panel and said elongated support member are assembled, thereby preventing horizontal separation of said panel from said elongated linear support member.

6. The apparatus according to claim 5 wherein said top edge notch is further defined by an inclined surface distal to said inner panel edge and a vertical straight surface nearer than said inclined surface to said inner panel edge.

7. The apparatus according to claim 5 wherein said top edge notch is further defined by a top edge notch curved surface distal to said inner panel edge and a straight vertical surface nearer than said top edge notch curved surface to said top panel edge.

8. The apparatus according to claim 5 wherein said vertical flange is disposed at the edge of said horizontal web distal to said vertical web and said horizontal flange is disposed at the edge of said vertical web distal to said horizontal web, said horizontal flange extending from said vertical web by a distance equal to less than one quarter of the distance between said vertical web and said vertical flange.

9. An apparatus for building, erecting or suspending structures comprising:

(i) an elongated linear support member having a vertical web and a horizontal web, said vertical web being provided with a horizontally extending flange and said horizontal web being provided with a downwardly extending peg;

(ii) a panel configured and dimensioned to cooperate with said elongated linear support member so that said panel hangs substantially vertically from said support member with the plane of said panel substantially perpendicular to the length of said linear support member, said panel having a top edge and an inner edge, said inner edge being provided with an inner edge notch having a horizontal straight surface distal to said top edge and an inner edge notch curved surface nearer than said horizontal straight surface to said top edge, said inner edge notch being configured and dimensioned to receive said horizontal flange on said elongated linear support member and provide vertical support for said panel when said panel and said elongated linear support member are assembled; and (iii) engaging means between said top panel edge and said elongated linear support member including a blind hole provided in said top panel edge configured and dimensioned to receive said downwardly extending peg when said panel and said elongated support member are assembled, thereby preventing horizontal separation of said panel from said elongated linear support member.

10. An apparatus for building, erecting or suspending structures comprising:

(i) an elongated linear support member formed by a vertical web and a horizontal web, said vertical web having a horizontally extending flange and said horizontal web having a downwardly extending peg; and (ii) a panel configured and dimensioned to cooperate with said linear support member so that said panel hangs substantially vertically from said linear support member with the plane of said panel substantially perpendicular to the length of said linear support, (a) said panel having a top edge provided with a blind hole configured and dimensioned to receive said downwardly peg when said panel and said elongated linear support member are assembled, thereby preventing horizontal separation of said panel from said elongated linear support member, (b) said panel also having an inner edge provided with an inner edge notch defined by a lower horizontal straight surface distal to said top edge of said panel and an upper, inclined surface nearer than said lower horizontal surface to said top edge, such that said inner edge notch is configured and dimensioned to receive said horizontal flange when said panel and said elongated support member are assembled, thereby providing vertical support for said panel.

* * * * *